US010960431B1

(12) United States Patent
Elam

(10) Patent No.: US 10,960,431 B1
(45) Date of Patent: Mar. 30, 2021

(54) SEALANT APPLICATOR

(71) Applicant: TOCAL SPECIALTIES, LLC, Richmond, IN (US)

(72) Inventor: Chad Elam, Oxford, OH (US)

(73) Assignee: TOCAL SPECIALTIES, LLC, Richmond, IN (US)

( * ) Notice: Subject to any disclaimer, the term of this patent is extended or adjusted under 35 U.S.C. 154(b) by 0 days.

(21) Appl. No.: 16/750,341

(22) Filed: Jan. 23, 2020

Related U.S. Application Data

(60) Provisional application No. 62/795,627, filed on Jan. 23, 2019.

(51) Int. Cl.
*B05C 17/005* (2006.01)
*E04F 21/165* (2006.01)

(52) U.S. Cl.
CPC .... *B05C 17/00516* (2013.01); *E04F 21/1652* (2013.01)

(58) Field of Classification Search
CPC . B05C 17/005; B05C 17/00516; B65D 83/28; B65D 83/285; B65D 35/36; B65D 35/26; B65D 47/42
USPC ..... 401/261–267; 222/192, 562–563, 222/566–574, 526–539, 325–391
See application file for complete search history.

(56) References Cited

U.S. PATENT DOCUMENTS 2,982,987 A * 5/1961 Knapp ..... B43M 11/06 401/139
4,213,546 A * 7/1980 Massey ..... B65D 41/023 220/379
4,957,225 A 9/1990 Childers
D355,576 S * 2/1995 Groene ..... D8/70
5,413,258 A 5/1995 Kartler
D366,402 S * 1/1996 Groene ..... D8/14.1
D371,494 S * 7/1996 Groene ..... D8/14.1
5,833,099 A 11/1998 Boaz et al.
5,865,555 A 2/1999 Dawson
6,464,115 B2 10/2002 Wemyss et al.
6,981,611 B2 1/2006 Carruth et al.
7,014,079 B2 3/2006 Swann
7,644,464 B2 1/2010 Bommarito
8,307,490 B2 11/2012 Gringer et al.
D687,272 S 8/2013 Cross
8,991,662 B2 3/2015 Milan
2005/0230439 A1 10/2005 McKee
2007/0102484 A1 5/2007 Baldwin
(Continued)

FOREIGN PATENT DOCUMENTS

DE 2939031 A1 * 4/1981 ..... B05C 17/10

*Primary Examiner* — David J Walczak
*Assistant Examiner* — Randall A Gruby
(74) *Attorney, Agent, or Firm* — Daniel F. Nesbitt; Hasse & Nesbitt LLC

(57) ABSTRACT

A sealant applicator for spreading caulk material along a surface of a structure. The sealant applicator has an attachment base with a channel through which the tapered nozzle of the sealant tube extends. The sealant applicator also has an application blade that extends from the upper surface of the attachment base. The application blade has a triangular-shaped blade with a distal tip and opposed lateral wings, for spreading caulk material that is dispensed from the tapered nozzle, along a surface of a structure, to cover and seal joints and crevices in the surface of a structure.

20 Claims, 7 Drawing Sheets

(56) References Cited

U.S. PATENT DOCUMENTS

| | | | | |
|---|---|---|---|---|
| 2010/0278958 | A1* | 11/2010 | Chamberlain | E04F 21/165<br>425/458 |
| 2013/0064598 | A1* | 3/2013 | Williamson | B05C 17/10<br>401/267 |
| 2015/0190839 | A1 | 7/2015 | Hunt | |
| 2016/0067736 | A1 | 3/2016 | Lussier et al. | |

* cited by examiner

SEALANT APPLICATOR

CROSS-REFERENCE TO RELATED APPLICATIONS

This application claims the benefit of U.S. Provisional Application No. 62/795,627 filed Jan. 23, 2019, which is incorporated herein by reference in its entirety.

FIELD OF THE INVENTION

This invention relates to sealant devices in general, and more particularly, a sealant applicator that applies sealants including caulk materials on joints between two surfaces.

BACKGROUND OF THE INVENTION

Sealants and caulk are typically used to provide a resilient seal between two adjacent structures, such as a window frame and a brick wall, or between two surfaces, such as a bathtub surface and a tiled wall, to prevent water and air from entering the gap between the two adjacent structures or surfaces. Although caulking and sealing is desirable, it is often difficult to dispense the viscous caulk or sealant material into the gap between the structures with the straight, tapered dispensing tip of a sealant tube conventionally provided with the caulk and sealant containers.

Caulk and sealant are typically dispensed from a resilient tube through a dispensing nozzle using a plunger in the opposite end of the tube to pressurize and express the sealant through the nozzle tube. Typically, such a tube is placed into a device known as a caulking gun (or sealant gun) having a pull trigger or lever that allows the user to control the advancement of the plunger into the body of the tube, for controlling the rate and amount of caulking or sealant dispensed from the open nozzle. Non-limiting examples of a sealant gun (or caulk gun) are described in U.S. Pat. Nos. 5,456,389 and 5,372,286, the disclosures of which are incorporated by reference in their entireties. Other devices used for dispensing a sealant can include an open-ended tube with flexible walls that allow the sealant within the tube to be dispensed through opening by the user squeezing the walls of the tube in a hand.

One attempt to improve the application of caulk from an end of a caulk tube is disclosed in U.S. Pat. No. 6,769,578, which describes a flexible caulk tube nozzle that is integrally, formed of an inflexible plastic and includes a tapered tubular attaching portion that attaches to the caulk tube, and a dispensing portion that is angled from the attaching portion.

Another attempt to improve the application of caulk from a dispensing tip of a caulk tube is disclosed in U.S. Pat. No. 6,076,712, which describes a caulk tube nozzle applicator that fits over the end of a caulk tube, and is integrally formed and includes a tapered nozzle end portion, an accordion flexible section, and a caulk tube attachment portion that attaches to the caulk tube. The accordion flexible section allows the user to direct the tapered nozzle end portion at any angle relative to the caulk tube.

Another attempt to improve the application of caulk from a dispensing tip of a caulk tube is disclosed in U.S. Pat. No. 5,865,555, which describes a sealant applicator that fits over the dispensing tip of a caulk tube, the applicator including a T-shaped flexible plate that can be folded vertically to provide a substantially square caulk dispensing opening resulting in a substantially linear, uniform caulk joint that does not require smoothing or wiping.

There remains a need for an improved caulk applicator that can improve the application of the caulk material dispensed from the end of a sealant tube, onto the adjacent surfaces of the two adjacent structures, that eliminates wasted caulk and messy tools and hands, and provide a professional application of the caulk bead.

SUMMARY OF THE INVENTION

The present invention provides a device that is simple to use for dispensing and applying a substantially linear, uniform caulk joint that does not require smoothing or wiping. The device is configured to attach along the length of a nozzle of a sealant tube. The device includes a blade having a generally triangular shape including a distal tip and lateral wings. The blade is made with a thickness and of a material, at least along an edge of the perimeter of the blade, that is resilient and can flex out of the plane of the blade, at least along the edge.

In an embodiment of the invention, the device comprises a sealant applicator comprising an attachment base for attaching the sealant applicator to a tapered nozzle of a sealant tube, and an application blade extending from the attachment base for spreading sealant material along a surface of a structure.

In another embodiment of the invention, the sealant applicator for spreading sealant material along a surface of a structure comprises an attachment base for attaching the sealant applicator to a tapered nozzle of a sealant tube and a channel having an axis. The channel is configured to accept the tapered nozzle of the sealant tube along the axis when the sealant (caulk tub) applicator is attached to the tapered nozzle. The sealant applicator also comprises an application blade extending from the upper surface of the attachment base for spreading caulk material along a surface of a structure.

A sealant and a sealant tube as described herein can also include a caulk and a sealant tube, respectively, and a nozzle for a sealant tube as described herein can also include a nozzle for a sealant tube.

In yet another embodiment of the invention, the application blade has a triangular-shaped blade with a distal tip and opposed lateral wings.

In yet other embodiment of the invention, the application blade has a front face surface and a rear face surface that defines a thickness, and is made of a resilient material.

In another embodiment of the invention, an edge of the perimeter of the application blade has a thickness configured for the edge to be flexed out of the plane of the edge when the blade is pressed against the surface of the structure.

In yet another embodiment of the invention, the front face surface is concave.

In yet other embodiment of the invention, the opposed lateral wings of the application blade are curved forwardly and inwardly, and a distal edge of the lateral wings is curved forwardly and inwardly.

In another embodiment of the invention, the attachment base includes a pair of curved arms, and the channel is cylindrical in shape and is defined by the pair of curved arms.

In yet another embodiment of the invention, the channel tapers inwardly from a lower surface to the upper surface of the attachment base, and is configured to frictionally engage a frustaconical outer surface of the tapered nozzle of the sealant tube.

In yet other embodiment of the invention, the channel has a central axis that extends parallel to a front face surface of the application blade.

In another embodiment of the invention, the channel is aligned through the attachment base on a front face surface-side of the application blade, and the channel is configured to engage the tapered nozzle such that an opened dispensing tip of the tapered nozzle is disposed forward of a front face surface of the application blade.

In yet another embodiment of the invention, the attachment base further includes a closure for closing and sealing an opened dispensing tip of the tapered nozzle of the sealant tube, the closure comprising an elongated cavity configured to accept a frustaconical outer surface of the tapered nozzle of the sealant tube, and a post attached to a base of the elongated cavity and extending along an axis of the elongated cavity, and configured to extend into an opened dispensing tip of the tapered nozzle.

In yet other embodiment of the invention, a sidewall of the elongated cavity frictionally engages a frustaconical outer surface of the tapered nozzle.

In another embodiment of the invention; the elongated cavity extends through the lower surface of and into the attachment base.

BRIEF DESCRIPTION OF THE FIGURES

FIG. 12 shows a bottom view of the sealant applicator thereof and.

FIG. 23 shows a bottom view of the sealant applicator thereof and.

DETAILED DESCRIPTION OF THE INVENTION

Figure 6:
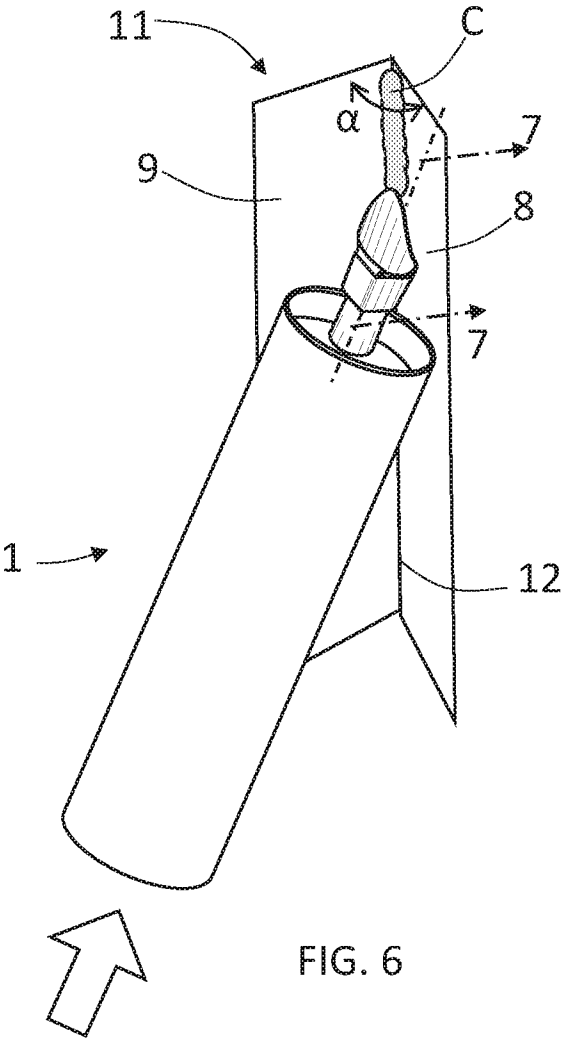
FIG. 6 shows the sealant tube with the sealant applicator of FIG. 5 dispensing and spreading caulk material onto a surface of a structure.

FIGS. 1-4 show a first embodiment of a sealant applicator 10 for spreading caulk material along a surface of a structure. An illustration of an example structure 11 is shown in FIG. 6, showing two adjacent surfaces 8,9 that are converge along a valley or corner 12. As is commonly known and practiced, caulk material C can be applied along the valley or corner 12 as a sealant.

Figure 5:
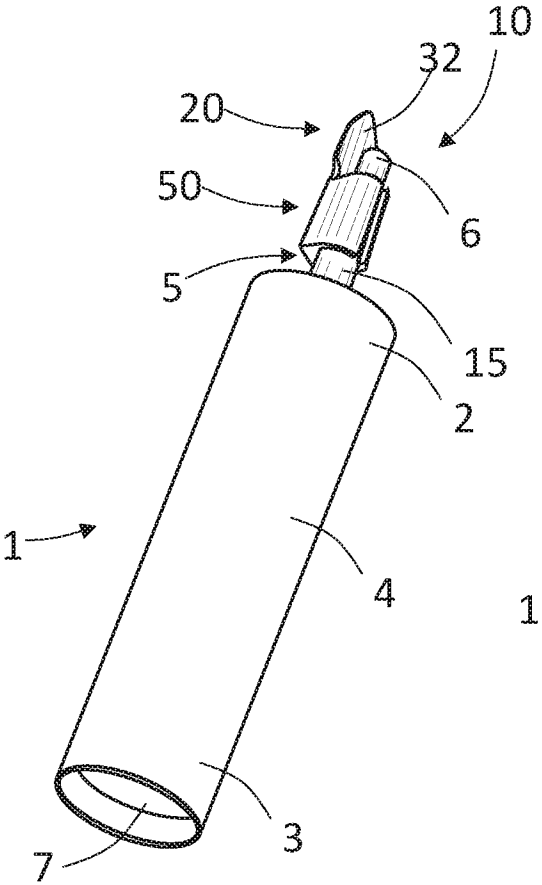
FIG. 5 shows a sealant tube with the sealant applicator of FIG. 1 affixed to the tapered nozzle of the sealant tube.

The sealant applicator 10 can include an attachment base 50 and an application blade 20. The attachment base 50 is configured for affixing temporarily the sealant applicator 10 to the tapered nozzle 5 of a sealant tube 1, shown in FIGS. 5 and 6. The attachment base 50 has an upper surface 59, a lower surface 53, and a channel 56 that extends along an axis 90, and passes between the upper surface 59 and the lower surface 53. The tapered nozzle 5 of the sealant tube 1 extends through the channel 56 and along the axis 90 when the sealant (caulk tub) applicator 10 is attached to the tapered nozzle 5. The channel 56 can have a cylindrical and tapered shape, tapering inwardly from the lower surface 53 to the upper surface 59 of the attachment base 50. In the illustrated embodiment, the attachment base 50 includes a pair of curved arms 54*a*,54*b* that extend laterally and outwardly and have an inner surface that defines in part the channel 56. The distal edges 55 of the arms 54*a*,54*b* are separated by a gap 57 to allow the opposed arms 54*a*,54*b* to flex outwardly and resiliently in order to grasp and frictionally engage a frustaconical outer surface 15 of the tapered nozzle 5. The sealant applicator 10 can be affixed to the tapered nozzle 5 by inserting the dispensing tip 6 of the tapered nozzle 5 through the bottom end of the channel 56 and firmly up into the channel 56.

The application blade 20 extends from the upper surface 59 of the attachment base 50 for spreading caulk material C that has been dispensed from a dispensing tip 6 of a sealant tube 1, along a surface of the structure 11. The application blade 20 has a front face surface 32 and a rear face surface 34 that define a thickness T, and is made of a resilient material. The blade 20 typically has a length of about 3 to 8 cm, and a width, from wing edge to wing edge, of about 2 to 6 cm. The thickness T of the blade 20 is typically about 1 mm to about 5 cm, for example, about 2-3 mm.

Figure 1:
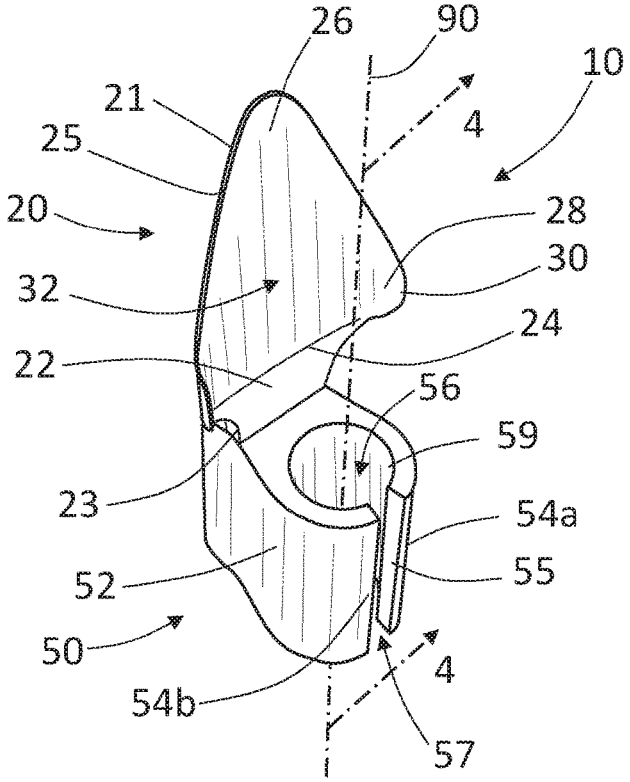
FIG. 1 shows a top front perspective view of a sealant applicator according to the present invention.
Figure 2:
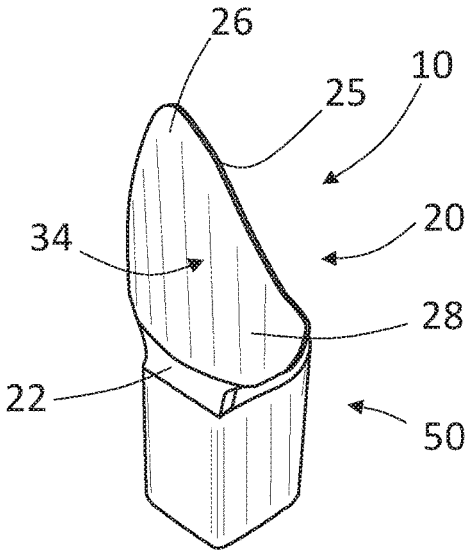
FIG. 2 shows a top back perspective view of the sealant applicator of FIG. 1.
Figure 3:
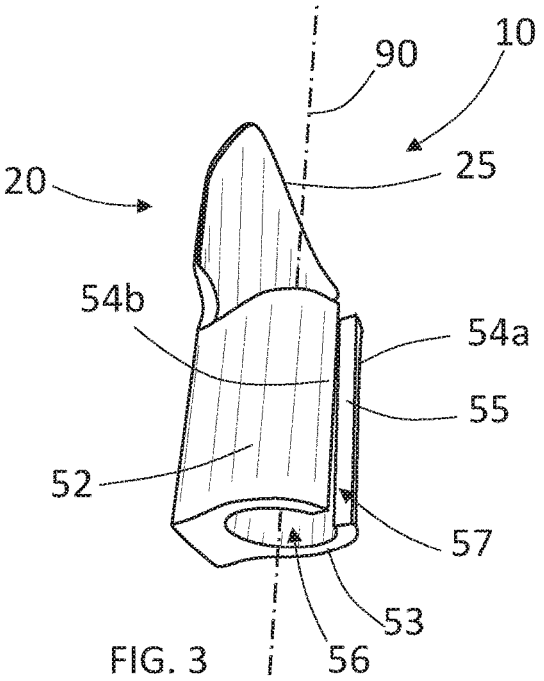
FIG. 3 shows a bottom front perspective view of the sealant applicator of FIG. 1.
Figure 4:
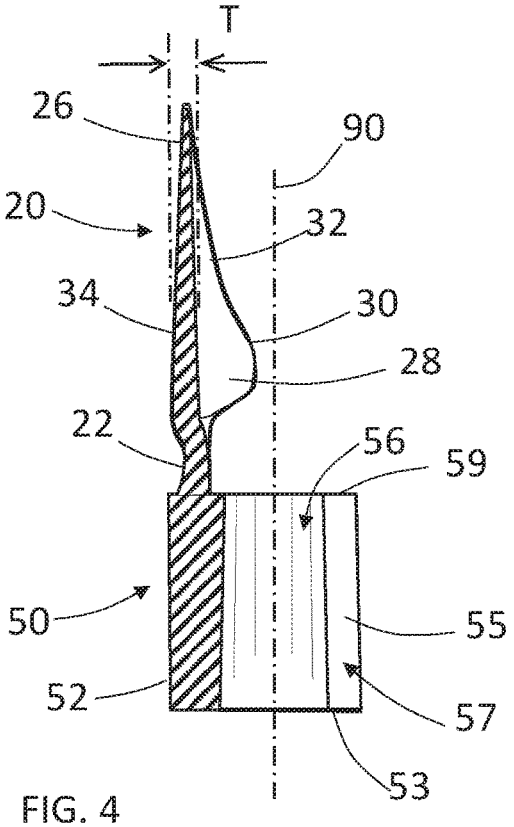
FIG. 4 shows a sectional view of the sealant applicator taken through line 4-4 of FIG. 1.
Figure 7:
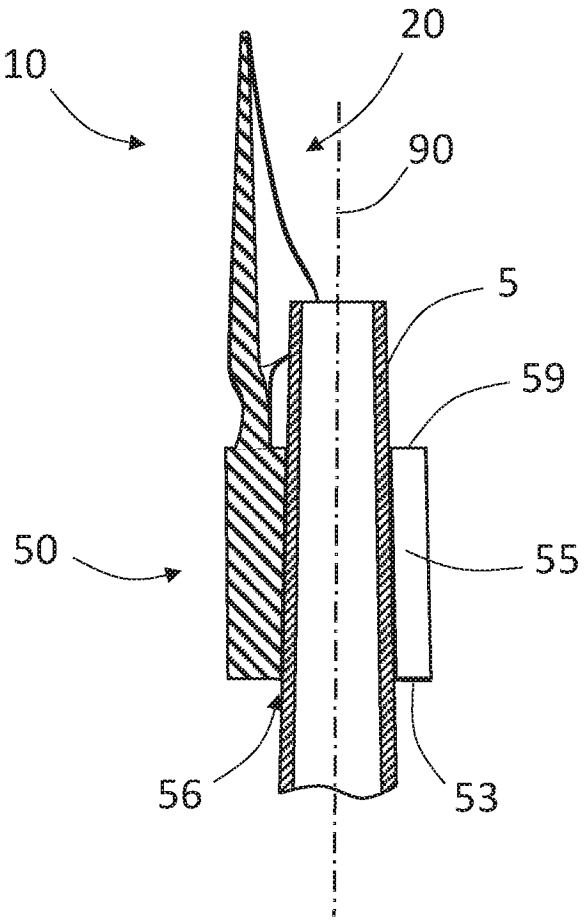
FIG. 7 shows a sectional view of the sealant applicator affixed to the tapered nozzle of FIG. 6.

In the illustrated embodiment of the invention, the front face surface-side of the blade 20 is off-set laterally from the central axis 90, extends parallel to the central axis 90 of the channel 56. When the tapered nozzle 5 of the sealant tube 1 is engaged in the channel 56 and is affixed to the sealant applicator 10, as shown in FIG. 7, an opened dispensing tip 6 of the tapered nozzle 5 is disposed forward of the front face surface 32 of the application blade 20. The caulk material C that is dispensed from the opened dispensing tip 6 is immediately guided and spread by the front face surface 32 of the blade 20 into the corner 12 of the structure 11.

In the illustrated embodiment, the application blade 20 has a triangular-shaped blade with a distal tip 26 and opposed lateral wings 28. The thickness and the material of the blade 20 is sufficient to maintain the position and orientation when in use to apply and spread caulk material C onto the structure 11. An edge 25 of the perimeter of the blade 20 can have an edge thickness that is configured so that the edge 25 can flex out of its formed shape when the blade 20 is pressed against the surfaces 8,9 of the structure. The triangular-shape of the blade 20 allows the sealant applicator 10 to be angled to the valley or corner 12 during application of caulk material C, as the opposed lateral side edges 25 of the blade 20 can ride along the adjacent surfaces 8,9 of the structure 11.

In the illustrated embodiment, the front face surface 32 is slightly concave, defined by a radius that is at least five times, and up to about 50 times the lateral width of the blade 20. The opposed lateral wings 28 of the blade 20 are further curved forwardly and inwardly, and the thickness of the opposed lateral wings 28 thin toward a distal edge 30, which adds flexibility out of the plane of the wings 28. The thickness along the edges 25 of the blade 20 and the distal edge 30 of the opposed lateral wings 28 is typically less than about 2 mm, for example less than 1, and about 0.5 to 1 mm.

Figure 8:
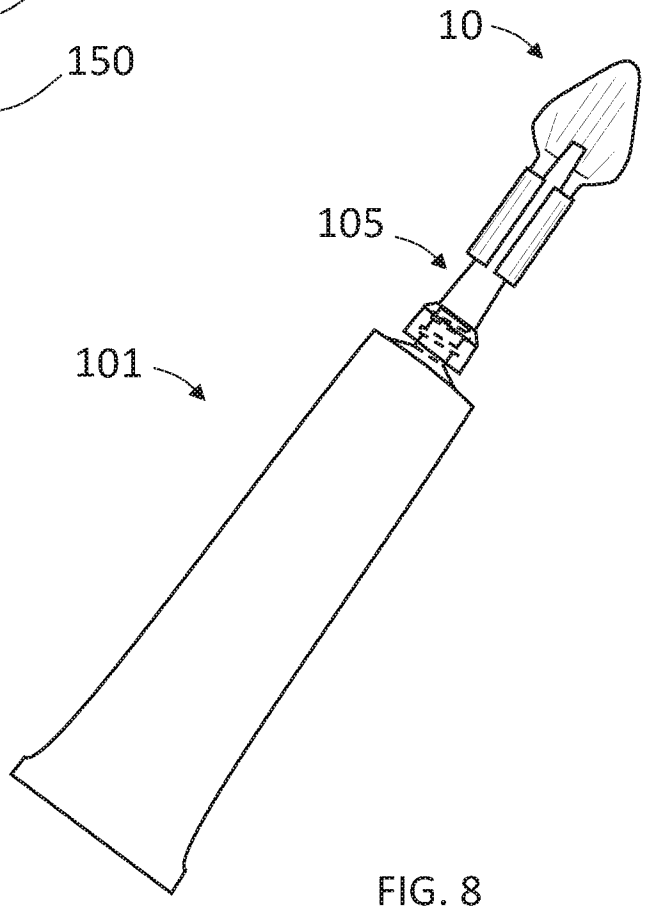
FIG. 8 shows a sealant applicator attached to a nozzle of a squeeze-type sealant tube.

FIG. 8 shows a sealant applicator 10 as described, attached to a tapered nozzle 105 of a squeeze-type sealant tube sealant tube 101.

FIGS. 9 through 13 show orthogonal views of the sealant applicator 10, including front, back, top, bottom and side views.

FIGS. 14 through 19 show an alternative embodiment of the invention, showing a sealant applicator 110, where the same elements and features are similarly numbered, or are numbered in the hundreds, FIGS. 20 through 24 show orthogonal views of the sealant applicator 110, including front, hack, top, bottom and side views.

Figure 19:
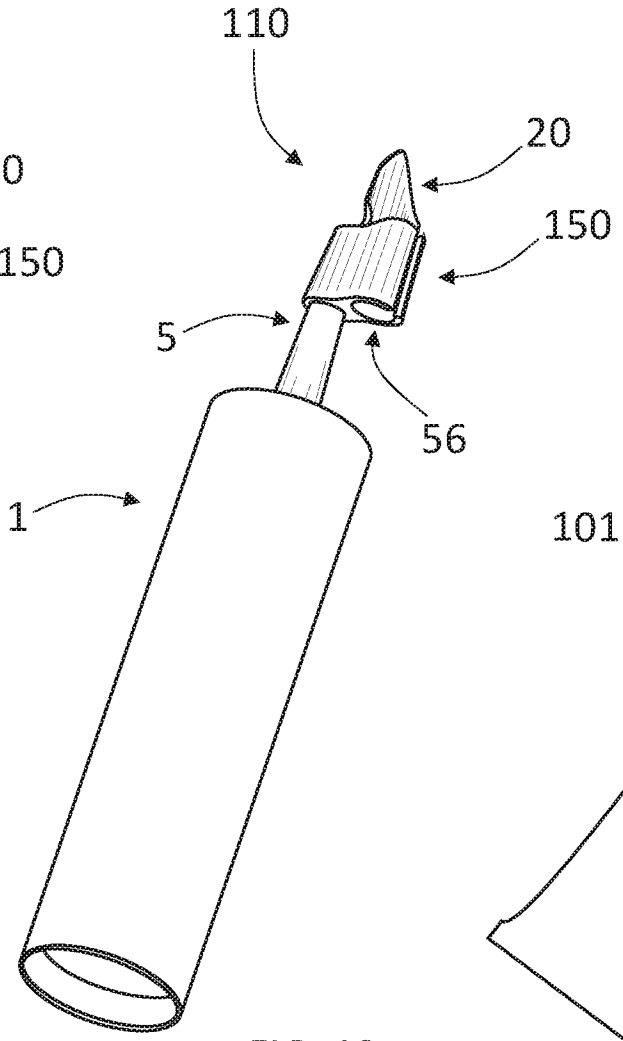
FIG. 19 shows a rear perspective view of the sealant tube and sealant applicator of FIG. 18.
Figure 18:
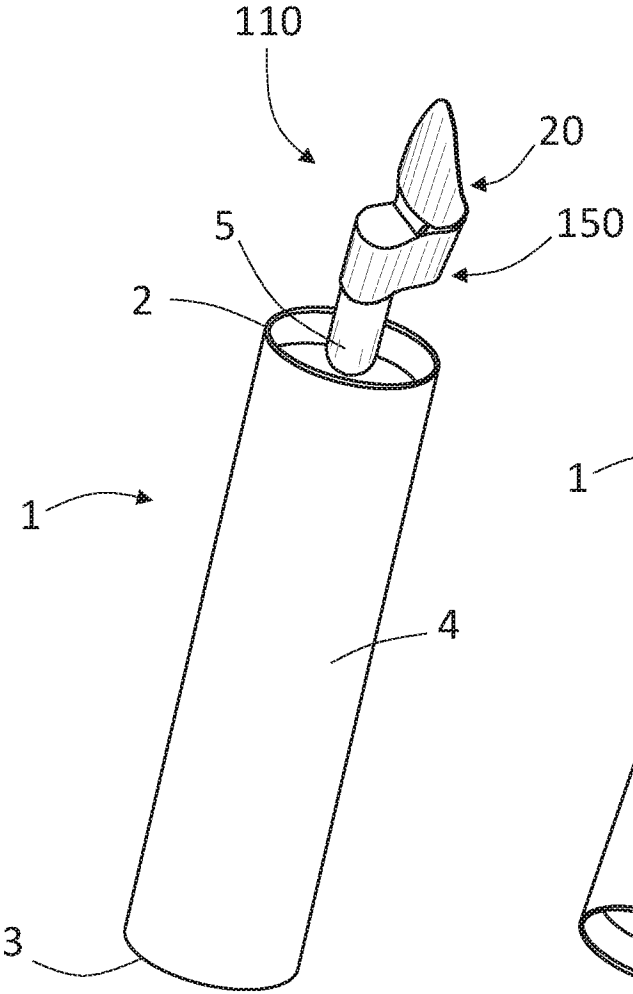
FIG. 18 shows a front perspective view of sealant tube with the sealant applicator of FIG. 14 affixed to seal the tapered nozzle of the sealant tube.
Figure 13:
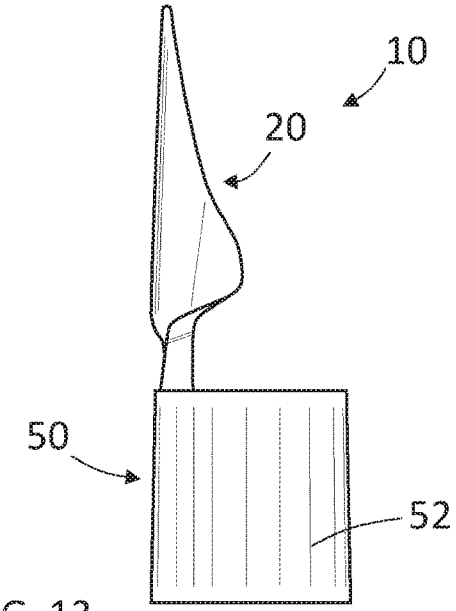
FIG. 13 shows a left side view thereof, the right-side view being a mirror image thereof.
Figure 10:
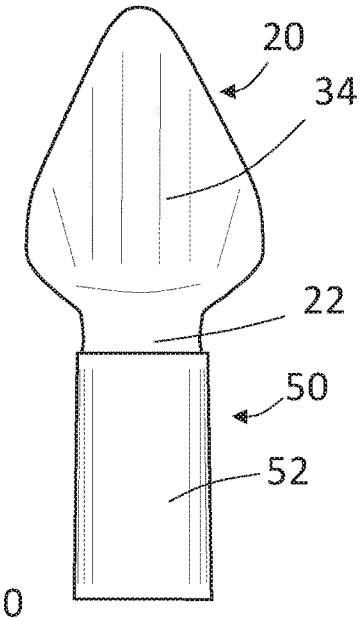
FIG. 10 shows a back view of the sealant applicator thereof.
Figure 9:
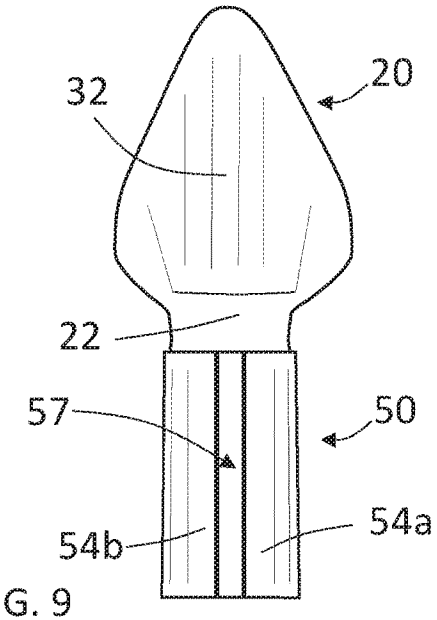
FIG. 9 shows a front view of the sealant applicator of FIG. 1.
Figure 12:
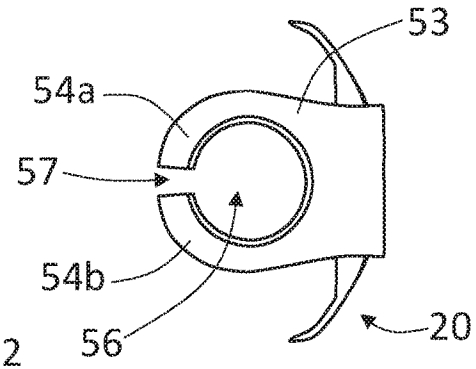
Figure 11:
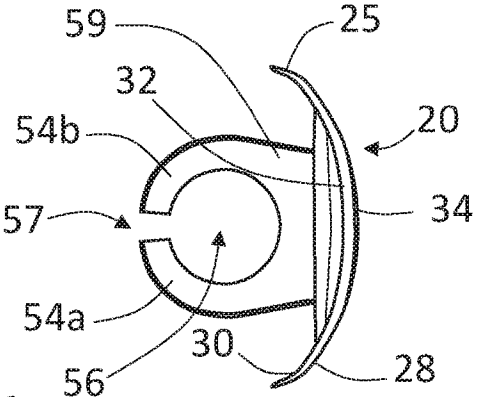
FIG. 11 shows a top view of the sealant applicator thereof.
Figure 14:
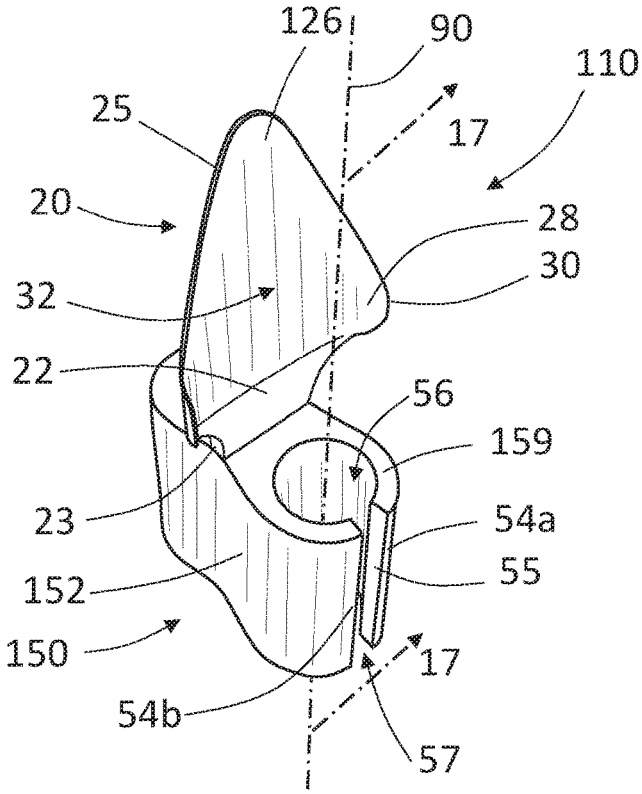
FIG. 14 shows a top front perspective view of another embodiment of a sealant applicator according to the present invention.
Figure 15:
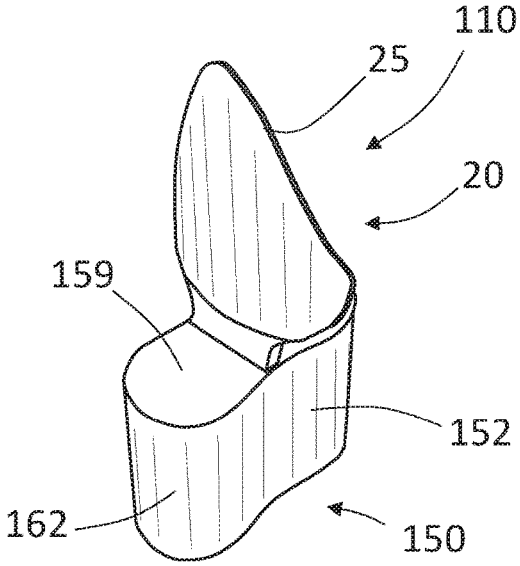
FIG. 15 shows a top back perspective view of the sealant applicator of FIG. 14.
Figure 16:
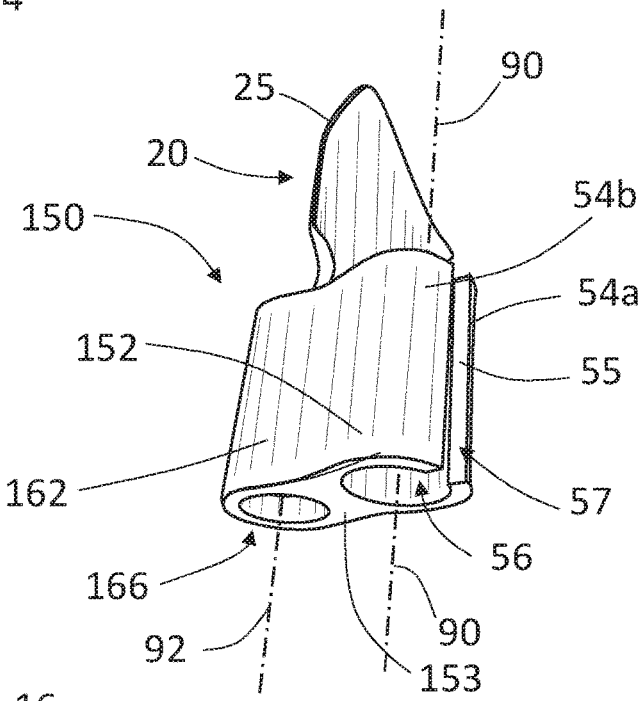
FIG. 16 shows a bottom front perspective view of the sealant applicator of FIG. 14.
Figure 17:
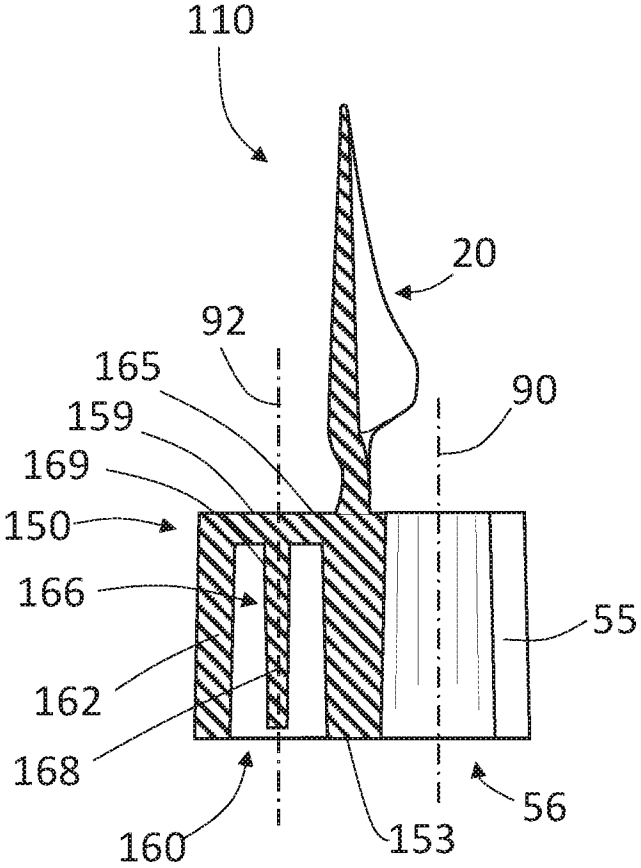
FIG. 17 shows a sectional view of the sealant applicator taken through line 17-17 of FIG. 14.
Figure 21:
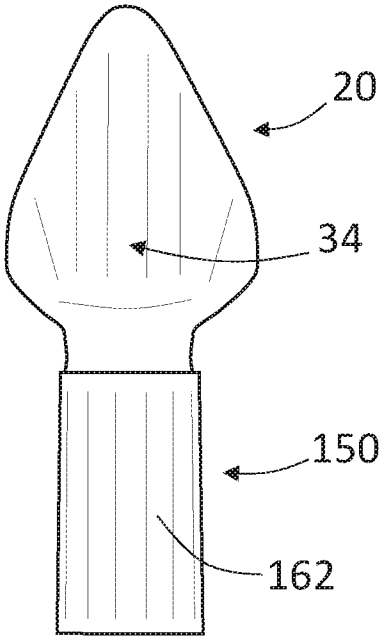
FIG. 21 shows a back view of the sealant applicator thereof.
Figure 20:
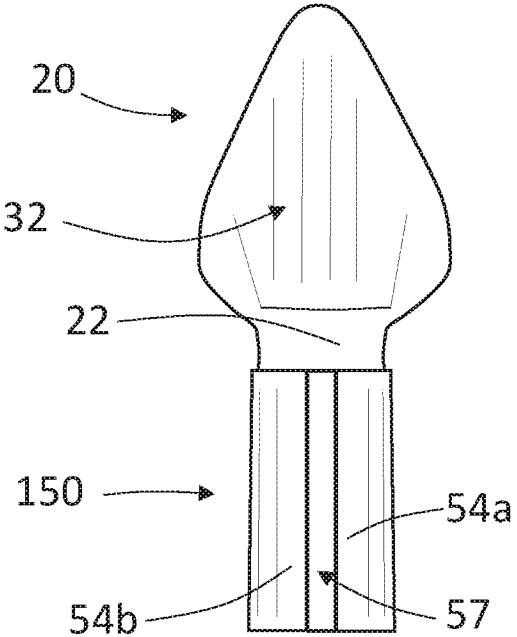
FIG. 20 shows a front view of the sealant applicator of FIG. 12.
Figure 22:
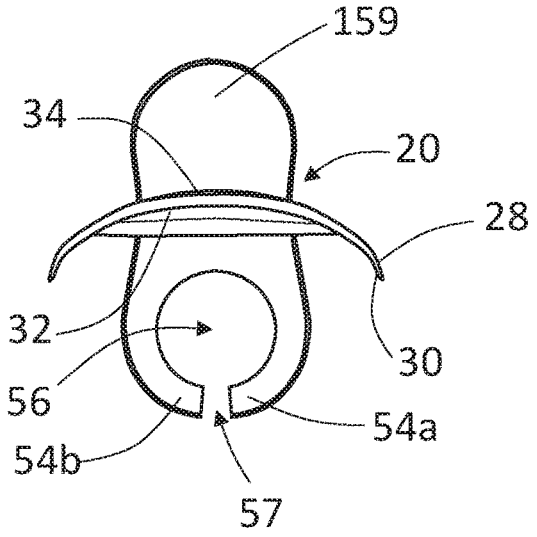
FIG. 22 shows a top view of the sealant applicator thereof.
Figure 23:
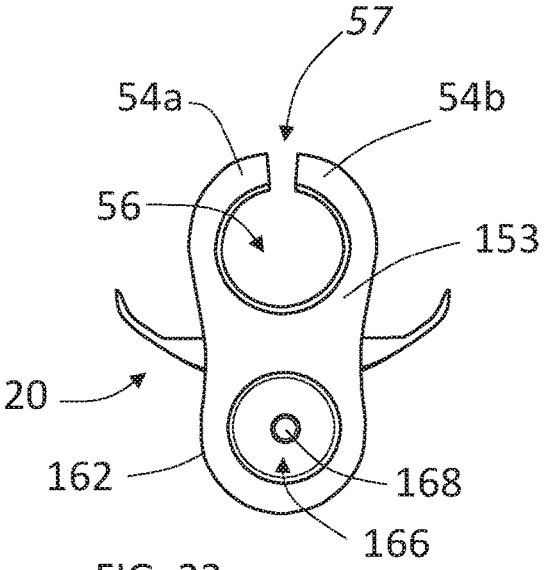
Figure 24:
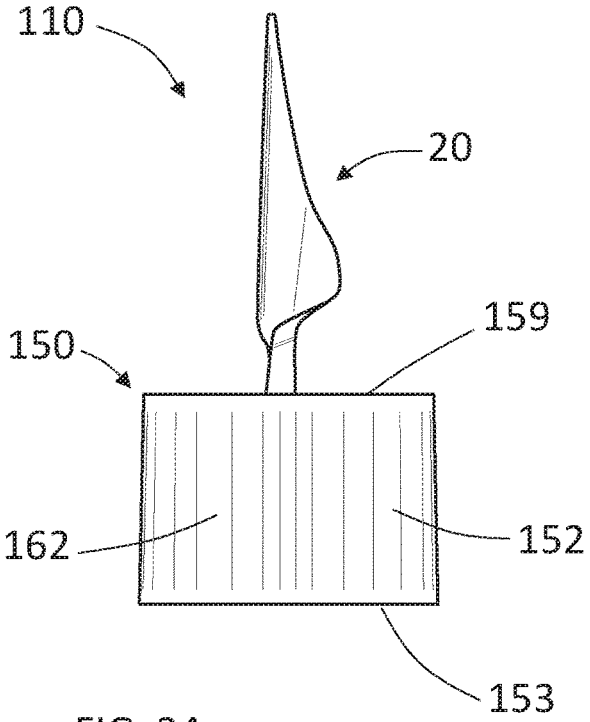
FIG. 24 shows a left side view thereof, the right-side view being a mirror image thereof.

The sealant applicator 110 can include an attachment base 150 and an application blade 20. The attachment base 150 includes the channel 56 as described for the earlier embodiment, and further includes a closure 66 for closing and sealing an opened dispensing tip 6 of the tapered nozzle 5 of the sealant tube 1. The closure 160 has an elongated cavity 166 configured to accept or accommodate the frustaconical outer surface 15 of the tapered nozzle 5 of the sealant tube. The closure 160 also includes a cylindrical post 168 attached at a proximal end 169 to a base 165 of the elongated cavity 166. The post 168 extends along an axis 92 of the elongated cavity 166, toward the lower surface 53 of the attachment base 150. The post 168 is configured to extend into an opened dispensing tip 6 of the tapered nozzle 5, to close and seal the opened dispensing tip 6, to prevent the caulk material inside the nozzle 5 and tube 1 from drying out or hardening. After use of the sealant applicator 110 as an applicator to spread caulk material C, as shown in FIG. 6 for the earlier embodiment, the sealant applicator 110 can be used to as a closure to close and seal the dispensing tip 6 of the tapered nozzle 5, as shown in FIGS. 18 and 19.

I claim:

1. A sealant applicator for spreading caulk material along a surface of a structure, comprising:

a) an attachment base having an upper surface and a lower surface, and a channel having an axis through the upper surface of the attachment base for attaching the sealant applicator to a tapered nozzle of a sealant tube, wherein the channel is configured to accept the tapered nozzle of the sealant tube along the axis when the sealant applicator is attached to the tapered nozzle, the attachment base further having an elongated cavity configured to accept a frustoconical outer surface of the tapered nozzle of the sealant tube for closing and sealing an opened dispensing tip of the tapered nozzle of the sealant tube, and b) an application blade extending from the upper surface of the attachment base for spreading caulk material along a surface of a structure.

2. The sealant applicator according to claim 1 wherein the axis of the channel extends parallel to a front face surface of the application blade.

3. The sealant applicator according to claim 2 wherein the opposed lateral wings of the application blade are curved forwardly and inwardly, and a distal edge of the lateral wings is curved forwardly and inwardly.

4. The sealant applicator according to claim 2 wherein the upper surface of the attachment base includes a base that forms a closed end of the elongated cavity, and a post attached to the base of the elongated cavity and extending along an axis of the elongated cavity, and configured to extend into an opened dispensing tip of the tapered nozzle.

5. The sealant applicator according to claim 1 wherein the application blade has a front face surface and a rear face surface that define a thickness, and is made of a resilient material.

6. The sealant applicator according to claim 5 wherein an edge of the perimeter of the application blade has a thickness configured for the edge to be flexed out of the plane of the edge when the application blade is pressed against the surface of the structure.

7. The sealant applicator according to claim 5 wherein the front face surface is concave.

8. The sealant applicator according to claim 1 wherein the attachment base includes a pair of curved arms, and the channel is cylindrical in shape and is defined by the pair of curved arms.

9. The sealant applicator according to claim 1 wherein the channel tapers inwardly from a lower surface to the upper surface of the attachment base, and is configured to frictionally engage a frustaconical outer surface of the tapered nozzle of the sealant tube.

10. The sealant applicator according to claim 1 wherein the channel has a central axis that extends parallel to a front face surface of the application blade.

11. The sealant applicator according to claim 10 wherein the channel is aligned through the attachment base on a front face surface-side of the application blade, and the channel is configured to engage the tapered nozzle such that an opened dispensing tip of the tapered nozzle is disposed forward of a front face surface of the application blade.

12. The sealant applicator according to claim 1 wherein the upper surface of the attachment base includes a base that forms a closed end of the elongated cavity and a post attached to the base of the elongated cavity and extending along an axis of the elongated cavity, and configured to extend into an opened dispensing tip of the tapered nozzle.

13. The sealant applicator according to claim 12 wherein the post extends along the axis to the lower surface of the attachment base.

14. The sealant applicator according to claim 12 wherein the application blade has a triangular-shaped blade with a distal tip and opposed lateral wings that are curved forwardly and inwardly, and a distal edge of the lateral wings is curved forwardly and inwardly.

15. The sealant applicator according to claim 14 wherein the elongated cavity extends into the attachment base through the lower surface and along an axis that extends parallel with the axis of the channel and through the upper surface of the attachment base on a back face surface side of the application blade.

16. The sealant applicator according to claim 14 wherein the post extends along the axis to the lower surface of the attachment base.

17. The sealant applicator according to claim 1 wherein a sidewall of the elongated cavity frictionally engages the frustoconical outer surface of the tapered nozzle.

18. The sealant applicator according to claim 17 wherein the elongated cavity extends into the attachment base through the lower surface and along an axis that extends parallel with the axis of the channel and through the upper surface of the attachment base on a back face surface side of the application blade.

19. The sealant applicator according to claim 18 wherein the upper surface of the attachment base includes a base that forms a closed end of the elongated cavity, and a post attached to the base of the elongated cavity and extending along an axis of the elongated cavity, and configured to extend into an opened dispensing tip of the tapered nozzle.

20. The sealant applicator according to claim 1 wherein the elongated cavity extends into the attachment base through the lower surface and along an axis that extends parallel with the axis of the channel and through the upper surface of the attachment base on a back face surface side of the application blade.

* * * * *